US006171102B1

(12) United States Patent
Freeman et al.

(10) Patent No.: US 6,171,102 B1
(45) Date of Patent: Jan. 9, 2001

(54) DECORATIVE CANDLE DISPLAY

(75) Inventors: Scott H. Freeman, Huntington Beach; Frank H. Asbury, Anaheim, both of CA (US)

(73) Assignee: Primal Elements, Inc., Garden Grove, CA (US)

( * ) Notice: Under 35 U.S.C. 154(b), the term of this patent shall be extended for 0 days.

(21) Appl. No.: 09/559,689

(22) Filed: Apr. 27, 2000

(51) Int. Cl.[7] ..... F23D 3/16
(52) U.S. Cl. ..... 431/291; 431/288
(58) Field of Search ..... 431/288, 289, 431/291, 320, 296, 298; 362/161

(56) References Cited

U.S. PATENT DOCUMENTS

| | | | | |
|---|---|---|---|---|
| D. 424,719 | | 5/2000 | Freeman . | |
| 3,583,853 | * | 6/1971 | Schram | 431/291 |
| 5,927,965 | * | 7/1999 | Pappas | 431/288 |
| 6,033,210 | * | 3/2000 | Freeman | 431/291 |
| 6,068,472 | * | 5/2000 | Freeman | 431/288 |

OTHER PUBLICATIONS

"What is Wax"–Petroleum Wax Manufacturing–Simple overview —2 web pages.
"Candle Making–Waxes"—web pages.
"Making Candles", by Mary Talbot, 3 pages.
"Candle Creations", by James W. Gick, Jr., Index and Forward and 3 pages.
"Homespun Floral Candles", Country Living Gardener, Nov./Dec. 1996, pp. 92 and 93.

* cited by examiner

*Primary Examiner*—James C. Yeung
(74) *Attorney, Agent, or Firm*—Stetina Brunda Garred & Brucker

(57) ABSTRACT

A decorative candle display and a method for its manufacture. The display includes a container with an open top and an interior wall surface and a core candle with an exposed wick situated within the container. Core candle size and placement is such that a chamber is formed between the candle and the wall surface, and a candle wax material filler is disposed within the chamber. A colored gelatinous structure is disposed on top of the core candle and has a substantially vertical aperture through which the wick, extending from the core candle, resides for ignitable exposure above the gel structure. Fabrication methodology includes application of heat to the gelatinous structure to round any pointed border portions thereof and to imbue a sheen to the structure as an inherent heat-induced reaction occurs in the gelatinous material for such sheen production. The decorative candle display here defined provides an aesthetically pleasing contribution by visually combining flame color with gelatinous-structure hues as the candle burns.

22 Claims, 2 Drawing Sheets

DECORATIVE CANDLE DISPLAY

BACKGROUND OF THE INVENTION

The present invention relates in general to decorative candles, and in particular to a decorative candle display including a container within which is disposed a core candle whose wick extends through an aperture in a colored gelatinous structure and which is surrounded with candle wax to thereby fill the container and provide a generally level top surface upon which the gelatinous structure resides.

Candles have become very popular for decorative purposes, and as such are being formed in different styles, shapes, and colors. Typically, there are three different types of candles: tapered, molded, and container, and all are generally fabricated of a candle wax material which may include paraffin wax, vegetable wax, or beeswax. Fragrances and/or pigments can be added to the wax material to enhance individual candle characteristics.. Typically, the fragrance and/or pigment is mixed with the wax when in a molten state, and the treated wax is then formed into the preferred type of candle. In this manner, an aroma and/or color can be made integral with an otherwise traditional product.

In addition to making candles out of wax material, mineral oil has been used to create gel candles. The mineral oil is gelatinous and a solid at ambient temperature, and generally will burn longer than candles made from a wax material because of the high oil content of the gel. As desired, gel candles may additionally be scented and/or colored to add variety. Additionally, gelatinous gel can be manufactured in sheet form which then can be cut in cookie-cutter fashion to create variously shaped gel components for decorative inclusion with traditional molded candles.

While the qualities of wax material and gelatinous material are recognized, an object of the present invention is to provide a decorative candle display in which wax material and gelatinous material are united to create a candle display where both materials combine with each other to produce a novel flame effect.

Another object of the present invention is to provide a decorative candle display incorporating a container within which is disposed a candle wax material forming a surface from which a wick extends to integrally cooperate with a gel structure.

Yet another object of the present invention is to provide a method of fabricating a decorative candle display wherein a core candle with a wick extending therefrom and a surrounding wax filler are introduced into a container and thereafter integrally coupled via the wick with a gel structure.

These and other objects of the present invention will become apparent throughout the description thereof which now follows.

BRIEF SUMMARY OF THE INVENTION

The present invention is a decorative candle display and a method for its manufacture. The candle display comprises a container with an open top and an interior wall surface, and a core candle fabricated of a candle wax material with an exposed wick extending upwardly therefrom situated within the container. Core candle size and placement is such that a chamber is formed between the core candle and the wall surface, and a candle wax material filler is disposed within the chamber. A colored gelatinous structure is disposed on top of the core candle and has a substantially vertical aperture through which the wick, extending from the core candle, resides for ignitable exposure above the gel structure.

Methodology for manufacturing the decorative candle display comprises placing a core candle having an exposed wick extending upwardly therefrom and fabricated of a candle wax material into a container such that a chamber is formed between the core candle and the interior wall surface of the container. A colored gelatinous structure with a substantially vertical aperture there through is placed on top of the core candle and the exposed wick of the candle is drawn through the aperture to project above the gelatinous structure. A molten candle wax material filler is then poured into the chamber and cooled to thereby form a solid filler. Finally, for aesthetic purposes, radiant heat or heat from a hot air flow is applied to the gelatinous structure to round any pointed border portions thereof and to imbue a sheen to the structure as an inherent heat-induced reaction occurs in the gelatinous material for such sheen production. The decorative candle display here defined provides an aesthetically pleasing contribution upon wick ignition thereof by visually combining flame color with gelatinous-structure hues as the candle burns.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
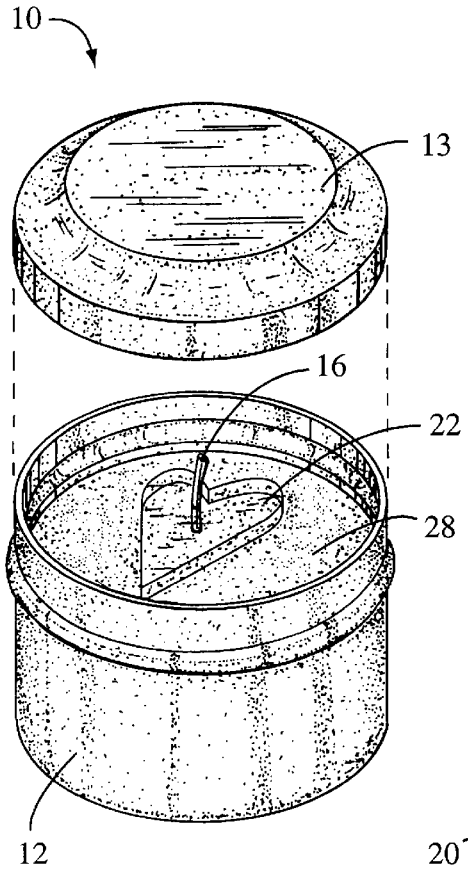
FIG. 1 is a perspective view of a decorative candle display including a container and a lid therefor.
Figure 2:
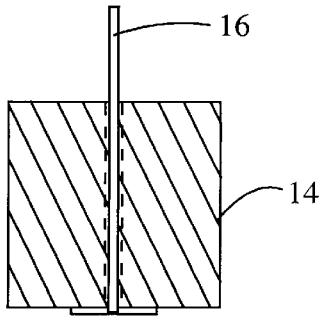
FIG. 2 is a side elevation view in section of a core candle fabricated of a candle wax material.
Figure 3:
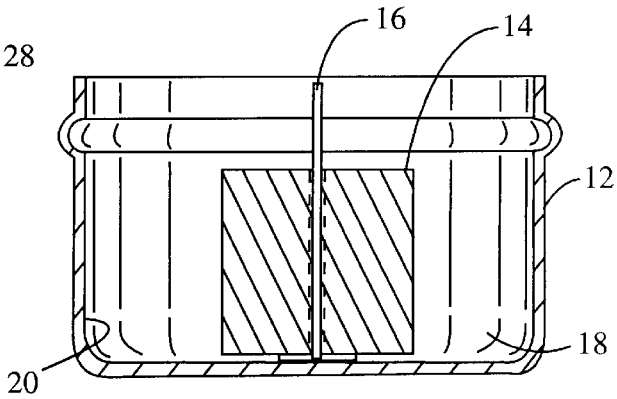
FIG. 3 is a side elevation view in section of the container component of FIG. 1 with solely the core candle of FIG. 2 therein.
Figure 4:
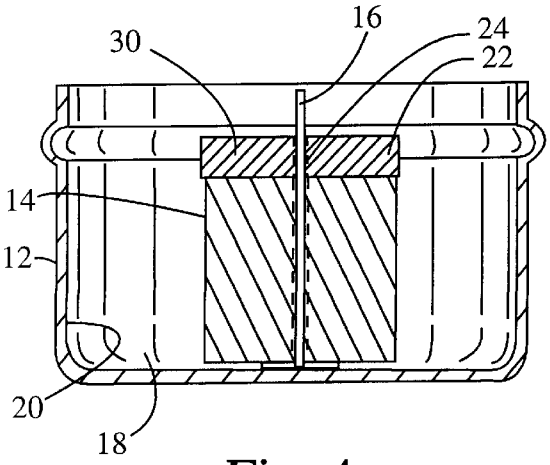
FIG. 4 is a side elevation view in section of the container component as shown in FIG. 3 additionally with a colored gelatinous structure atop the core candle.

Referring to FIGS. 1–5, a decorative candle display 10 is illustrated. The display 10 includes an open-top container 12, which can be transparent or opaque and can include a lid member 13 for closing the open top, and a core candle 14 disposed therein at a preferably generally central site within the container 12. The core candle 14 is fabricated of a candle wax material, preferably a conventional paraffin wax, with a wick 16 extending upwardly therefrom as known in the art. As shown in FIGS. 3 and 4, a chamber 18 is formed between the core candle 14 and the interior wall surface 20 of the container 12. Positioned on top of the core candle 14 is a colored gelatinous structure 22, as shown in FIG. 4, which can have a defined shape such as the heart shape shown in FIGS. 1 and 6. The gelatinous structure 22 is cut in cookie-cutter fashion from a gelatinous sheet manufactured from a mineral oil gel which is solid, yet also flexible. Such a gel product is available as "Candle Gel" and "Versa Gel," both manufactured by Penrico Company, Woodland, Tex. The structure 22 includes a vertical aperture 24 centrally located therethrough and through which the wick 16 of the core candle 14 is passed such that the wick 16 extends upwardly from the structure 22.

Figure 5:
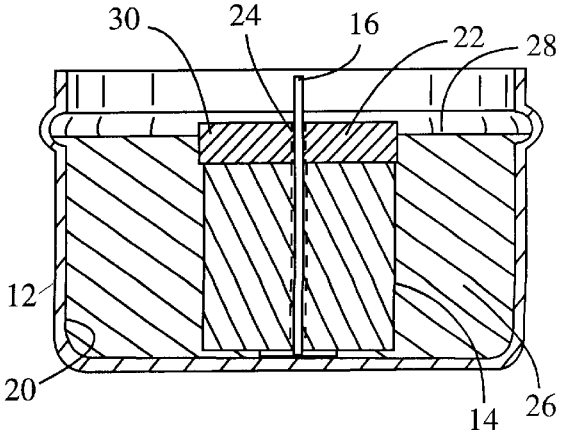
FIG. 5 is a side elevation view in section of the container component as shown in FIG. 4 additionally with a candle wax material filler surrounding the core candle.
Figure 6:
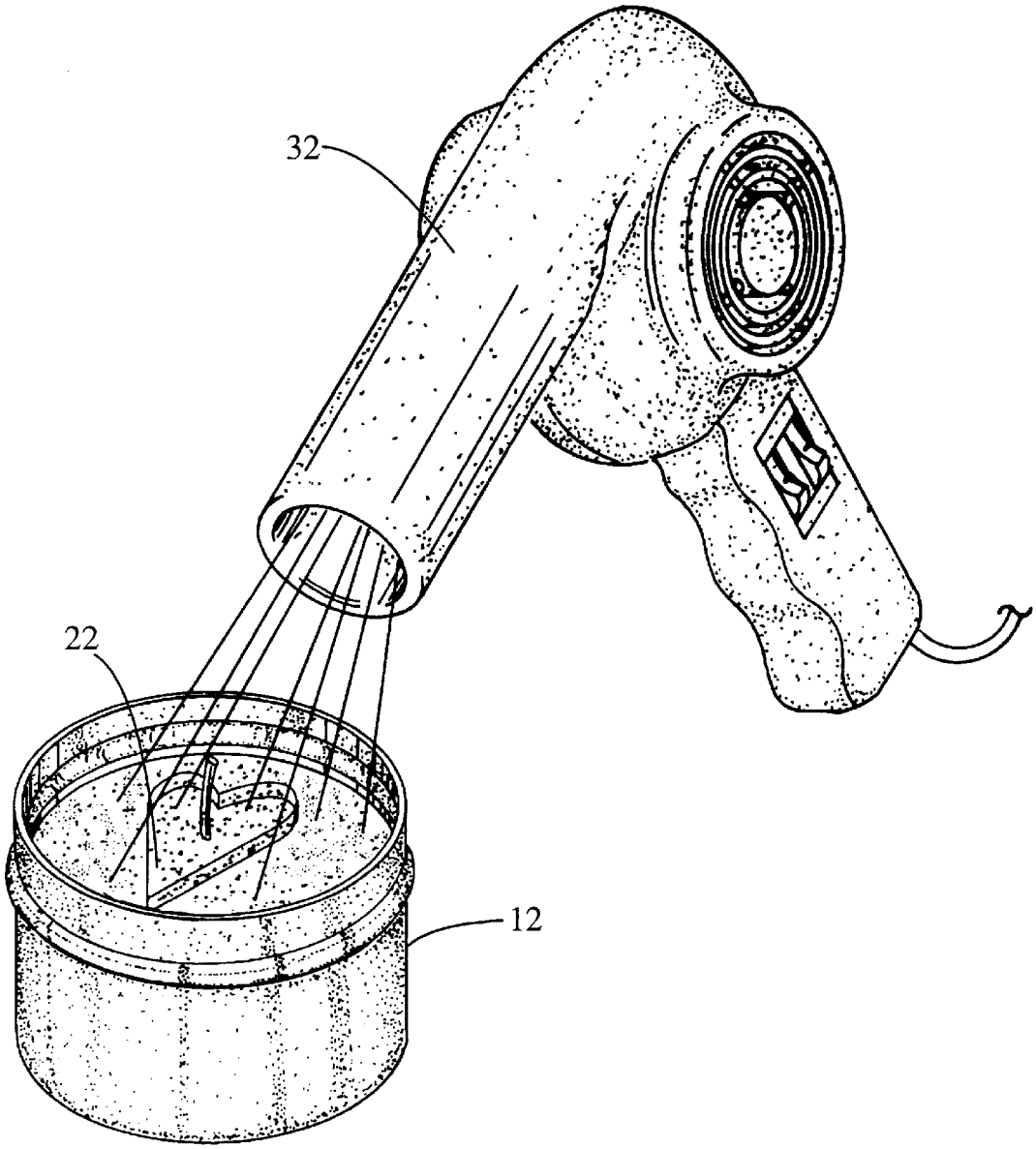
FIG. 6 is a perspective view of heat application on the top surface of the candle display.

The chamber 18 is filled by pouring a quantity of a molten candle wax material filler 26, preferably fabricated of the same material of the core candle 14 into the chamber 18 followed by cooling to form a solid filler 26. The quantity of molten filler 26 introduced into the chamber 18 is sufficient to form a top surface 28 of solid filler 26 preferably at least partially surrounding a perimeter surface 30 of the gelatinous structure 22, as illustrated in FIG. 5. Finally, radiant heat or heat from a hot air flow is applied to the gelatinous structure 22, as illustrated in FIG. 6 in emanating from a conventional hair dryer 32, at a temperature and time duration sufficient to round any unwanted pointed border portions of the structure 22 and for producing an inherent heat-generated sheen to the structure 22. If so desired, the filler 26 can have incorporated therewith a fragrance and/or pigment, typically mixed with the filler when in a molten state as known in the art, to thereby provide a unique aroma and/or appearance.

In use upon wick ignition, the decorative candle display 10 here defined provides a pleasing combination of flame color synergistically interacting with gelatinous-structure color tones as the candle burns. If fragrance and/or pigment is included as described above, a pleasing aroma and/or enhanced coloring can add to the decorative aspects of the display. Finally, when not in use, the container 12 can be closed with the lid 13 to thereby provide a conveniently transportable product.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

We claim:

1. A decorative candle display comprising:

a) a container with an open top and an interior wall surface;

b) a core candle fabricated of a candle wax material situated within the container such that a chamber is formed between the core candle and the wall surface, said core candle having an exposed wick extending upwardly therefrom;

c) a colored gelatinous structure disposed on top of the core candle, said gelatinous structure having a substantially vertical aperture through which said wick extends; and d) a candle wax material filler disposed within the chamber.

2. A decorative candle display as claimed in claim 1 wherein the container includes a lid for selectively closing the open top.

3. A decorative candle display as claimed in claim 1 wherein the candle wax material is paraffin.

4. A decorative candle display as claimed in claim 1 wherein the colored gelatinous structure is formed of a mineral oil gel.

5. A decorative candle display as claimed in claim 4 wherein the surface of the colored gelatinous structure has a sheen.

6. A decorative candle display as claimed in claim 4 wherein the colored gelatinous structure has a defined shape.

7. A decorative candle display as claimed in claim 1 wherein the colored gelatinous structure has a defined shape.

8. A decorative candle display as claimed in claim 1 wherein the aperture of the colored gelatinous structure is substantially centrally disposed.

9. A decorative candle display as claimed in claim 1 wherein the filler is of a depth sufficient to surround at least a portion of a perimeter surface of the colored gelatinous structure.

10. A decorative candle display as claimed in claim 1 wherein the filler additionally comprises a pigment.

11. A decorative candle display as claimed in claim 1 wherein the filler additionally comprises a fragrance.

12. A method of manufacturing a decorative candle display comprising the steps of:

a) providing a container with an interior wall surface;

b) placing a core candle fabricated of a candle wax material into the container such that a chamber is formed between the core candle and the wall surface, said core candle having an exposed wick extending upwardly therefrom;

c) placing a colored gelatinous structure with a substantially vertical aperture there through on top of the core candle and positioning the wick of the candle through said aperture to project above the gelatinous structure;

d) pouring a quantity of a molten candle wax material filler into the chamber and cooling said filler to form a solid filler; and e) applying heat to the gelatinous structure at a temperature and duration of time sufficient for rounding any pointed border portions of said structure and for imbuing a sheen to said structure.

13. A method as claimed in claim 12 wherein the container includes a lid for selectively closing the open top.

14. A method as claimed in claim 12 wherein the candle wax material is paraffin.

15. A method as claimed in claim 12 wherein the colored gelatinous structure is formed of a mineral oil gel.

16. A method as claimed in claim 15 wherein the surface of the colored gelatinous structure has a sheen.

17. A method as claimed in claim 15 wherein the colored gelatinous structure has a defined shape.

18. A method as claimed in claim 12 wherein the colored gelatinous structure has a defined shape.

19. A method as claimed in claim 12 wherein the aperture of the colored gelatinous structure is substantially centrally disposed.

20. A method as claimed in claim 12 wherein the filler is poured to a depth sufficient to surround at least a portion of a perimeter surface of the colored gelatinous structure.

21. A method as claimed in claim 12 wherein the filler additionally comprises a pigment.

22. A method as claimed in claim 12 wherein the filler additionally comprises a fragrance.

* * * * *